US010976680B2

(12) United States Patent
Watanabe et al.

(10) Patent No.: US 10,976,680 B2
(45) Date of Patent: Apr. 13, 2021

(54) IMAGE FORMING APPARATUS IN WHICH AC-TYPE BIASING IS ADOPTED FOR CHARGING OR DEVELOPMENT

(71) Applicant: KYOCERA Document Solutions Inc., Osaka (JP)

(72) Inventors: Takuji Watanabe, Osaka (JP); Norio Tomiie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/737,426

(22) Filed: Jan. 8, 2020

(65) Prior Publication Data

US 2020/0241436 A1 Jul. 30, 2020

(30) Foreign Application Priority Data

Jan. 30, 2019 (JP) ..... JP2019-013790

(51) Int. Cl.
*G03G 15/02* (2006.01)
*G03G 15/06* (2006.01)
*G03G 15/00* (2006.01)

(52) U.S. Cl.
CPC ..... *G03G 15/0266* (2013.01); *G03G 15/065* (2013.01); *G03G 15/0216* (2013.01); (Continued)

(58) Field of Classification Search
CPC .. G03G 15/0266; G03G 15/065; G03G 15/80; G03G 15/0283; G03G 2215/021; G03G 15/0216
See application file for complete search history.

(56) References Cited

U.S. PATENT DOCUMENTS

2011/0058833 A1 3/2011 Yoshimoto ..... 399/50
2013/0287424 A1* 10/2013 Tamaoki ..... G03G 15/065 399/88

(Continued)

FOREIGN PATENT DOCUMENTS

JP 06242663 A * 9/1994
JP 09101656 A * 4/1997

(Continued)

OTHER PUBLICATIONS

English machine translation of JP-06242663-A (Year: 1994).*
English machine translation of JP-2007199377-A (Year: 2007).*
English machine translation of JP-09101656-A (Year: 1997).*

*Primary Examiner* — Walter L Lindsay, Jr.
*Assistant Examiner* — Geoffrey T Evans
(74) *Attorney, Agent, or Firm* — Stein IP, LLC

(57) ABSTRACT

In an image forming apparatus, a bias controller varies one, while keeping the other fixed, of a charging alternating-current frequency, which is the frequency of the charging alternating-current voltage, and a developing alternating-current frequency, which is the frequency of the developing alternating-current voltage. Specifically, in a case where interference fringes appear in a developed image due to interference between the charging and developing alternating-current frequencies, when the recognizable minimum pitch of the interference fringes is $A_1$ (mm), the width of the variation region of the other frequency is $B_1$ (Hz), the rotation speed of an image carrying member is $C_1$ (mm/sec), and the variation speed of the other frequency in the variation region is $D_1$ (Hz/sec), the bias controller varies the other frequency at a variation speed $D_1$ that fulfills $|D_1|>B_1/(A_1/C_1)$.

7 Claims, 7 Drawing Sheets

(52) U.S. Cl.
CPC ..... *G03G 15/0283* (2013.01); *G03G 15/80* (2013.01); *G03G 2215/021* (2013.01)

(56) References Cited

U.S. PATENT DOCUMENTS

| | | | | |
|---|---|---|---|---|
| 2017/0205727 | A1* | 7/2017 | Makiura | G03G 15/5029 |
| 2019/0265606 | A1* | 8/2019 | Kanai | G03G 15/047 |
| 2020/0241441 | A1* | 7/2020 | Watanabe | G03G 15/065 |

FOREIGN PATENT DOCUMENTS

| | | | | |
|---|---|---|---|---|
| JP | 2007199377 | A | * | 8/2007 |
| JP | 2011-59311 | A | | 3/2011 |

* cited by examiner

IMAGE FORMING APPARATUS IN WHICH AC-TYPE BIASING IS ADOPTED FOR CHARGING OR DEVELOPMENT

INCORPORATION BY REFERENCE

This application is based on and claims the benefit of Japanese Patent Application No. 2019-013790 flied on Jan. 30, 2019, the contents of which are hereby incorporated by reference.

BACKGROUND

The present disclosure relates to an image forming apparatus in which AC-type biasing is adopted for charging or development.

An image forming apparatus of an electrophotographic type employs a charger of a contact type that performs electrostatic charging by bringing a charging member having a voltage applied to it into contact with the surface of an image carrying member (to-be-charged member) such as a photosensitive drum. Electrostatic charging of a to-be-charged member by use of a charger of a contact type divides into DC charging and AC charging. In DC charging, as a charging bias, only a direct-current voltage Vdc is applied to the to-be-charged member to electrostatically charge the to-be-charged member. On the other hand, in AC charging, a charging bias having an alternating-current voltage Vac superposed on the direct-current voltage Vdc is applied to the to-be-charged member to electrostatically charge the to-be-charged member. AC charging is favored in recent years because, as compared with DC charging, it is effective in achieving uniform charging owing to the alternating-current component suppressing the variation of the charging voltage.

In AC charging, a charging bias that contains an alternating-current voltage Vac is applied to the to-be-charged member. This leads to the known problem of image defects in which interference fringes appear in the developed image due to the difference between the alternating-current frequency of the charging bias (in the present disclosure, referred to also as the "charging alternating-current frequency") and the alternating-current frequency of the developing bias (in the present disclosure, referred to also as the "developing alternating-current frequency") that is applied to the developer carrying member in the developing device.

As a solution, in one known configuration, prevention of the interference fringes is attempted by variably controlling the charging alternating-current frequency while keeping the developing alternating-current frequency in a frequency ratio of a multiple of an integer to the charging alternating-current frequency.

SUMMARY

According to one aspect of the present disclosure, an image forming apparatus includes: a charging device that applies to a charging member a charging bias having a charging alternating-current voltage superposed on a charging direct-current voltage and that brings the charging member close to or into contact with an image carrying member to electrostatically charge the surface of the image carrying member; an electrostatic latent image forming device that forms an electrostatic latent image on the surface of the image carrying member electrostatically charged by the charging device; a developing device that develops the electrostatic latent image on the surface of the image carrying member with a developing bias having a developing alternating-current voltage superposed on a developing direct-current voltage; and a bias controller that varies one, while keeping the other fixed, of a charging alternating-current frequency, which is the frequency of the charging alternating-current voltage, and a developing alternating-current frequency, which is the frequency of the developing alternating-current voltage. In a case where interference fringes appear in a developed image due to interference between the charging and developing alternating-current frequencies, when a recognizable minimum pitch of the interference fringes is $A_1$ (mm), a width of a variation region of the another of the charging and developing alternating-current frequencies is $B_1$ (Hz), a rotation speed of the image carrying member is $C_1$ (mm/sec), and a variation speed of the another of the charging and developing alternating-current frequencies in the variation region is $D_1$ (Hz/sec), then the bias controller varies the another of the charging and developing alternating-current frequencies at the variation speed $D_1$ that fulfills $|D_1|>B_1/(A_1/C_1)$.

This and other objects of the present disclosure, and the specific benefits obtained according to the present disclosure, will become apparent from the description of embodiments which follows.

DETAILED DESCRIPTION

In a configuration that attempts to prevent interference fringes by variably controlling a charging alternating-current frequency while keeping a developing alternating-current frequency in a frequency ratio of a multiple of an integer to the charging alternating-current frequency, to suppress image defects due to interference, it is necessary to perform highly accurate control such that the charging and developing alternating-current frequencies are in constant proportions. This requires a high-performance controller, and leads to increased cost of the circuit board on which the controller and its peripheral components (e.g., a storage) are mounted. Moreover, the need to design a circuit board specialized for highly accurate control leads to narrow design tolerances in the circuit board. Thus, considering the cost of and the design tolerances in the circuit board, it is desirable to suppress, by simple control, the image defects due to interference between the charging and developing alternating-current frequencies.

The present disclosure provides an image forming apparatus that can suppress, with simple control, image defects due to interference between a charging alternating-current frequency and a developing alternating-current frequency. Hereinafter, an embodiment of the present disclosure will be described with reference to the accompanying drawings.

[Outline of the Structure of an Image Forming Apparatus]

Figure 1:
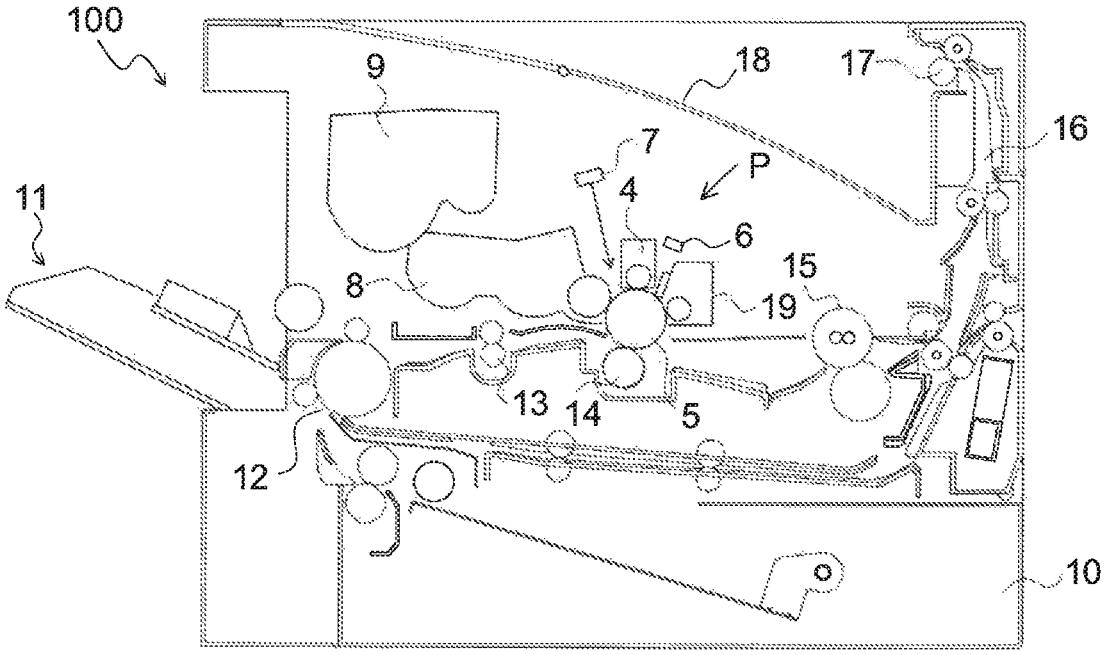
FIG. 1 is a sectional view showing the internal construction of an image forming apparatus according to one embodiment of the present disclosure.

FIG. 1 is a sectional view showing the internal construction of an image forming apparatus 100 (here, a monochrome printer) according to one embodiment of the present disclosure. Inside the image forming apparatus 100, there is disposed an image forming section P that forms a monochrome image through the processes of charging, exposure, development, and transfer. In the image formation section P are disposed, along the rotation direction (counter-clockwise in FIG. 1) of a photosensitive drum 5 as an image carrying member, a charging device 4, an exposure unit 7 as an electrostatic latent image forming device, a developing device 8, a transfer roller 14, a cleaning device 19, and a destaticizing device 6.

The photosensitive drum 5 is, for example, an amorphous silicon photoconductor that has an amorphous silicon layer, which is a positively chargeable photoconductor, as a photosensitive layer formed by deposition on the surface of a drum base tube made of aluminum, and has a diameter of about 30 mm. The photosensitive drum 5 is configured to be driven to rotate at a constant speed about a pivot shaft by a drum driver (not shown).

During image forming operation, the photosensitive drum 5 rotating counter-clockwise is electrostatically charged by the charging device 4 uniformly. Subsequently, with a laser beam based on document image data and shone from the exposure unit 7, an electrostatic latent image is formed on the photosensitive drum 5. Then, developer (hereinafter referred to as toner) is attached to the electrostatic latent image by the developing device 8 to form a toner image. The document image data mentioned above is transmitted from a host device such as a personal computer (not shown). Toner is supplied to the developing device 8 from a toner container 9.

On the other hand, toward the photosensitive drum 5 on which the toner image has been formed, a sheet (recording medium) is conveyed from a sheet feed cassette 10 or from a manual feeding device 11 via a sheet conveying passage 12 and a pair of registration rollers 13. Then, by the transfer roller 14, the toner image formed on the surface of the photosensitive drum 5 is transferred to the sheet. The toner that remains on the surface of the photosensitive drum 5 is removed by the cleaning device 19. Then, the electric charge that remains on the surface of the photosensitive drum 5 is removed by the destaticizing device 6.

The sheet having the toner image transferred to it is separated from the photosensitive drum 5, and is conveyed to a fixing device 15, where the toner image is fixed. The sheet having passed through the fixing device 15 is conveyed through a sheet conveying passage 16 to an upper part of the image forming apparatus 100, and is discharged by a pair of discharge rollers 17 onto a discharge tray 18.

[Details of the Image Forming Section]

Figure 2:
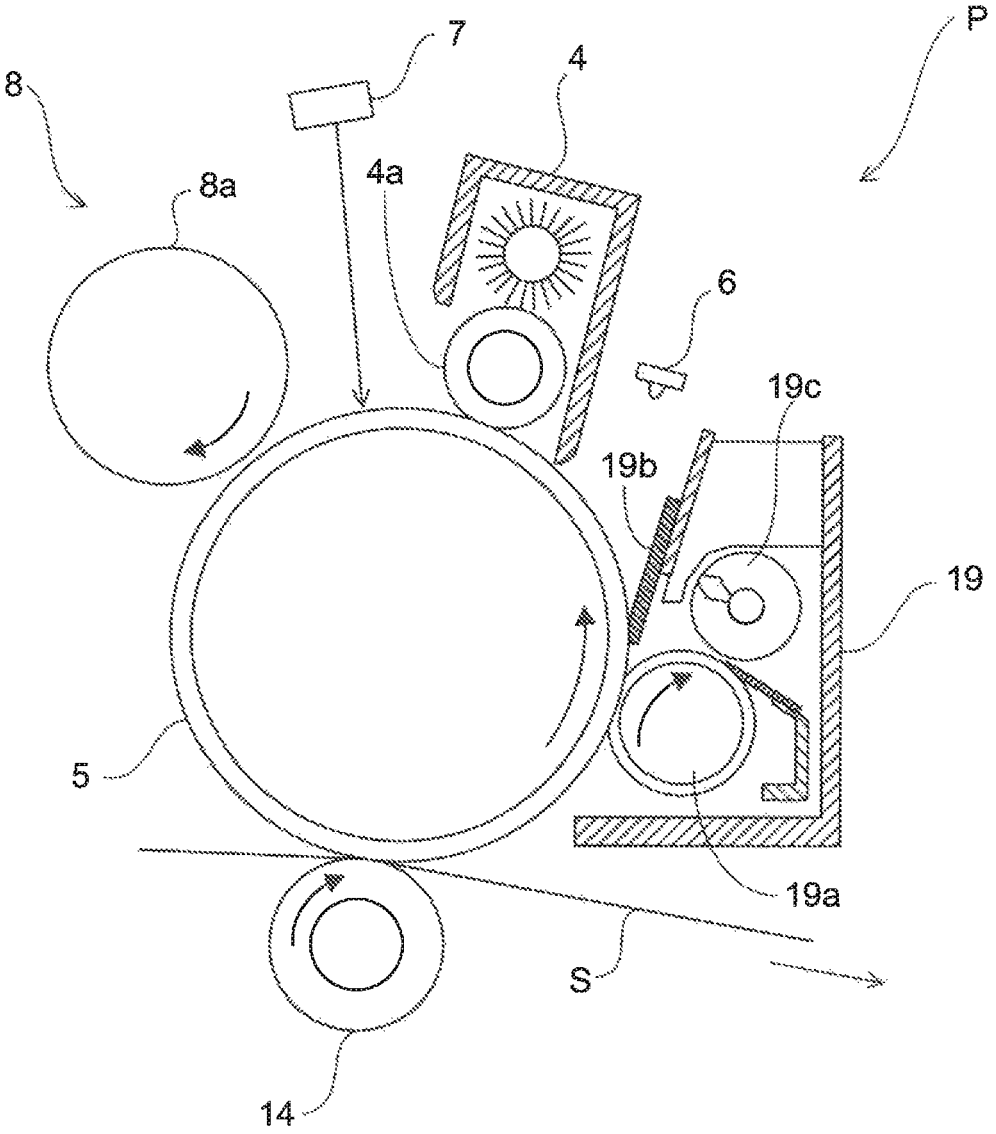
FIG. 2 is a sectional view showing an image forming section in the image forming apparatus on an enlarged scale.

Next, the image forming section P mentioned above will be described in detail. FIG. 2 is a sectional view showing the image forming section P mentioned above on an enlarged scale. The charging device 4 is a charging device of a contact charging type, and has a charging roller 4*a* (charging member) that is arranged in contact with the surface of the photosensitive drum 5. The charging device 4, while applying a charging bias V1 to the charging roller 4*a*, makes the charging roller 4*a* rotate in contact with the photosensitive drum 5, and thereby electrostatically charges the surface of the photosensitive drum 5 to a predetermined potential.

The charging bias V1 is generated by superposing a charging alternating-current voltage V1ac on a charging direct-current voltage V1dc. Used as the alternating-current component of the charging bias V1 is, for example, a sinusoidal wave. For example, when the frequency of the alternating-current component of a developing bias V2, which will be described later, is constant, the frequency of the alternating-current component of the charging bias V1 can be varied within a desired frequency width per unit period under the control of a bias controller 33 (see FIG. 3), which will be described later.

The exposure unit 7 performs, based on the document image data, exposure of the surface of the photosensitive drum 5 electrostatically charged by the charging device 4, and thereby forms an electrostatic latent image on the surface of the photosensitive drum 5. The exposure here is achieved by a method in which laser light is reflected by a rotating polygon mirror to scan the surface of the photosensitive drum 5. Accordingly, on the surface of the photosensitive drum 5, the electrostatic latent image is formed at a frequency that reflects the scanning pitch. In the present disclosure, this frequency is referred to also as the latent image frequency. The scanning pitch mentioned above corresponds to the resolution of the electrostatic latent image, and therefore the latent image frequency can be said to be a frequency that defines the resolution of the electrostatic latent image. The exposure unit 7 as an electrostatic latent image forming device can be any that can form an electrostatic latent image on the photosensitive drum 5 at a constant period through digital processing, and can be built with, for example, a MEMS or an LED array.

The developing device 8 has a developing roller 8*a*. The developing roller 8*a* feeds the toner stored in the toner container 9 in the developing device 8 to the photosensitive drum 5, and thereby develops the electrostatic latent image formed on the surface of the photosensitive drum 5. The toner that is fed from the developing roller 8*a* to the photosensitive drum 5 is, for example, toner having two parts by weight of titanium oxide (with a particle diameter of 0.1 μm and a resistance of $1\times10^7$ Ωcm) as an abrasive and 0.5 parts by weight of hydrophobic silica as a flow enhancer added to 100 parts by weight of toner particles.

Here, the feeding of toner from the developing roller 8*a* to the photosensitive drum 5 is achieved by the application of a developing bias to the developing roller 8*a* and the resulting formation of an electric field between the developing roller 8*a* and the photosensitive drum 5. The developing bias is generated by superposing together a developing direct-current voltage V2dc and a developing alternating-current voltage V2ac. Used as the alternating-current component of the developing bias is, for example, a rectangular wave. For example, when the frequency of the alternating-current component of the charging bias V1 is constant, the frequency of the alternating-current component of the developing bias V2 can be varied within a desired frequency width per unit period under the control of the bias controller 33. The toner image developed on the photosensitive drum 5 is transferred to a sheet S by the transfer roller 14.

The cleaning device 19 includes a cleaning roller 19*a* made of foamed polyurethane, a cleaning blade 19*b*, and a toner collector 19*c*. The cleaning roller 19*a* and the cleaning blade 19*b* are arranged each in contact with the photosensitive drum 5. The toner collector 19*c* collects the toner removed from the photosensitive drum 5 by the cleaning roller 19*a* and the cleaning blade 19*b*. The cleaning roller 19*a* rotates with toner containing an abrasive present at where the cleaning roller 19*a* makes contact with the photosensitive drum 5; thus, the cleaning roller 19*a* rubs against the photosensitive drum 5 and thereby cleans the surface of the photosensitive drum 5.

[Controlling the Charging Bias and the Developing Bias]

Figure 3:
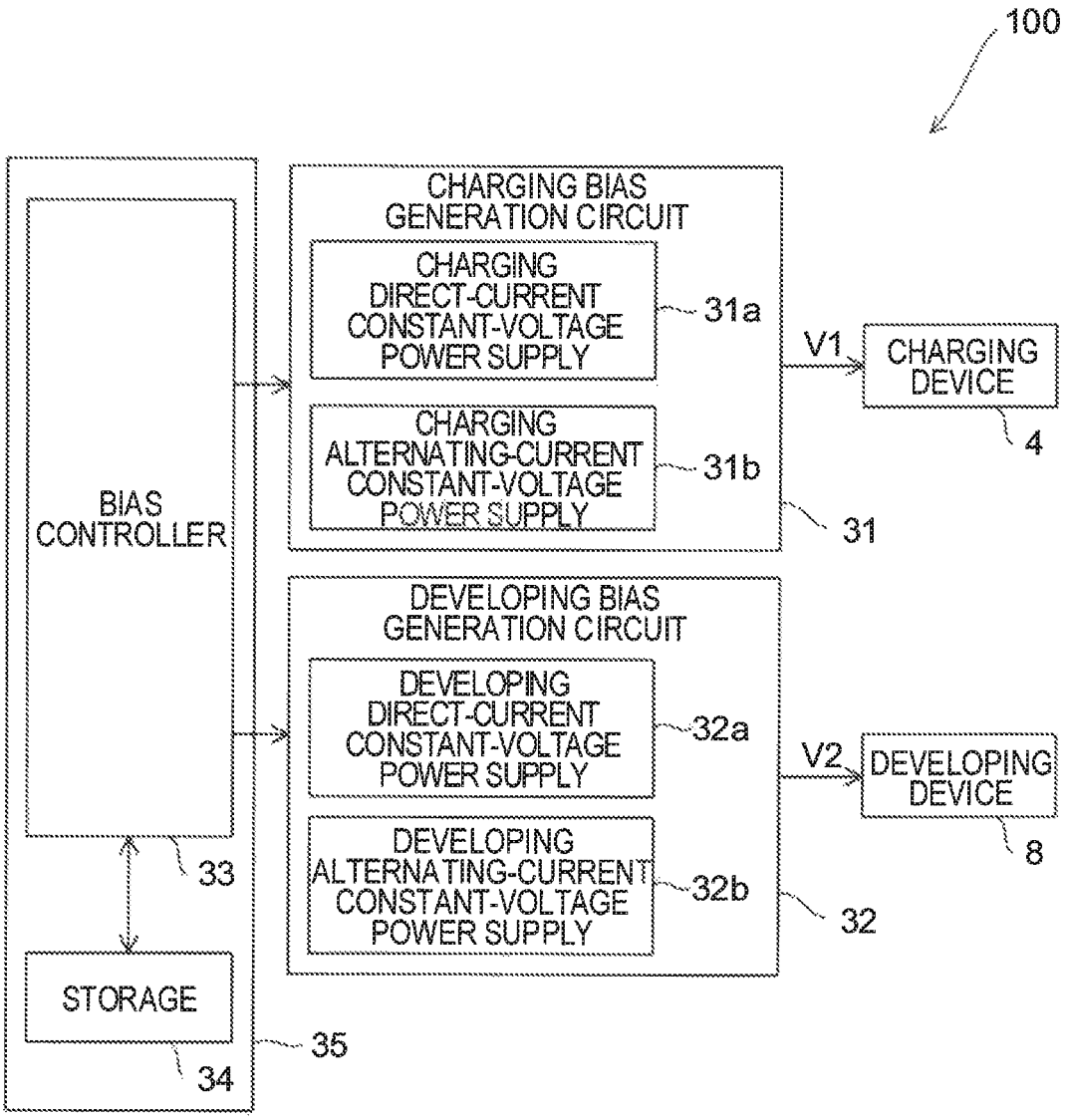
FIG. 3 is a block diagram schematically showing the configuration of a principal part of the image forming apparatus.

Next, how the charging bias V1 and the developing bias V2 mentioned above are controlled will be described. FIG. 3 is a block diagram schematically showing the configuration of a principal part of the image forming apparatus 100 according to the embodiment. The image forming apparatus 100 includes a charging bias generation circuit 31, a developing bias generation circuit 32, a bias controller 33, and a storage 34. The bias controller 33 and the storage 34 are mounted on a circuit board 35. The charging bias generation circuit 31 and the developing bias generation circuit 32 can be mounted on the circuit board 35, or can be mounted on a circuit board separate from the circuit board 35.

The storage 34 includes, for example, a ROM and a RAM, and stores a control program for operating the bias controller 33. Based on the control program, the bias controller 33 generates, for output to the charging bias generation circuit 31, a control signal (charging control signal) for generating the charging bias V1, and also generates, for output to the developing bias generation circuit 32, a control signal (development control signal) for generating the developing bias V2. The bias controller 33 so configured is, for example, built with a central processing unit (CPU).

The charging bias generation circuit 31 is a circuit that generates, based on the charging control signal from the bias controller 33, the charging bias V1 that is applied to the charging roller 4*a* in the charging device 4. The charging bias generation circuit 31 includes a charging direct-current constant-voltage power supply 31*a* and a charging alternating-current constant-voltage power supply 31*b*. The charging direct-current constant-voltage power supply 31*a* generates the charging direct-current voltage V1dc based on the above-mentioned charging control signal. The charging alternating-current constant-voltage power supply 31*b* generates the charging alternating-current voltage V1ac based on the charging control signal. In the charging bias generation circuit 31, the charging direct-current voltage V1dc and the charging alternating-current voltage V1ac are superposed together and thereby the charging bias V1 is generated. The charging roller 4*a* is electrostatically charged by being fed with the charging bias V1 from the charging bias generation circuit 31.

The developing bias generation circuit 32 is a circuit that generates, based on the development control signal from the bias controller 33, the developing bias V2 that is applied to the developing roller 8*a* in the developing device 8. The developing bias generation circuit 32 includes a developing direct-current constant-voltage power supply 32*a* and a developing alternating-current constant-voltage power supply 32*b*. The developing direct-current constant-voltage power supply 32*a* generates the developing direct-current voltage V2dc based on the above-mentioned development control signal. The developing alternating-current constant-voltage power supply 32*b* generates the developing alternating-current voltage V2ac based on the development control signal. In the developing bias generation circuit 32, the developing direct-current voltage V2dc and the developing alternating-current voltage V2ac are superposed together and thereby the developing bias V2 is generated. The developing bias V2 is applied to the developing roller 8*a*.

In the embodiment, the bias controller 33 performs control such that of the charging alternating-current frequency, that is, the frequency of the alternating-current component (charging alternating-current voltage V1ac) of the charging bias V1, and the developing alternating-current frequency, that is, the frequency of the alternating-current component (developing alternating-current voltage V2ac) of the developing bias V2, while one is kept fixed the other is varied. Specifically, when, in a situation the interference fringes appear in a developed image due to interference between the charging and developing alternating-current frequencies, the recognizable minimum pitch of the interference fringes is $A_1$ (mm), the width of the variation region of the charging or developing alternating-current frequency is $B_1$ (Hz), the rotation speed (linear velocity) of the photosensitive drum 5 is $C_1$ (mm/sec), and the variation speed of the charging or developing alternating-current frequency in the just-mentioned variation region is $D_1$ (Hz/sec), then the bias controller 33 varies the charging or developing alternating-current frequency at a variation speed $D_1$ that fulfills $$|D_1| > B_1/(A_1/C_1). \quad (1)$$

Conditional Formula (1) above defines an adequate range of the variation speed $D_1$ for reducing interference between the charging and developing alternating-current frequencies. That is, varying the charging or developing alternating-current frequency at a variation speed $D_1$ that fulfills Conditional Formula (1) helps reduce interference between the charging and developing alternating-current frequencies in the above-mentioned variation region, and thereby helps make the interference fringes due to the interference less visually recognizable. Thus, the control of the two frequencies no longer requires such high accuracy as conventionally required to keep the charging and developing alternating-current frequencies in constant proportions. Thus, it is possible to suppress the image defects due to interference between the charging and developing alternating-current frequencies with simpler control than conventionally practiced (with simple control where the charging or developing alternating-current frequency is varied at the variation speed $D_1$). Moreover, Conditional Formula (1) is worked out with consideration given to the rotation speed $C_1$ of the photosensitive drum 5, and thus, irrespective of how the rotation speed $C_1$ is set, it is possible to vary the charging or developing alternating-current frequency at an adequate variation speed $D_1$ in accordance with the rotation speed $C_1$ set, and thereby to appropriately suppress the image defects.

Performing highly accurate control as conventionally practiced requires a high-performance (high-throughput) controller and a large-capacity storage, and this may cause concern for increased cost of the circuit board on which the controller and the storage are mounted. In contrast, the embodiment requires no such highly accurate control, and thus does not cause concern for increased cost of the circuit board 35 on which the bias controller 33 and the storage 34 are mounted. Nor is it necessary to design a circuit board 35 specialized for highly accurate control, and this allows wider design tolerances in the circuit board 35.

Furthermore, irrespective of how one of the charging and developing alternating-current frequencies is set (fixed), it is possible, by varying the other, to suppress the image defects due to interference. Thus, it is conversely possible, without worrying about the image defects, to set one of the frequencies freely. This too allows wider design tolerances in the circuit board 35.

Incidentally, keeping the charging and developing alternating-current frequencies equal at the same frequency without varying either of them eliminates the image defects due to interference. However, the higher the rank of a model on the product line, the higher one of the charging and developing alternating-current frequencies; then the other too requires suitable control and a suitable circuit board design. This leads to increased cost of and narrower design tolerances in the circuit board 35.

Out of the considerations discussed above, the control in this embodiment, where while one of the charging and developing alternating-current frequencies is kept fixed, the other is varied in a way that fulfills Conditional Formula (1), can be said to be more advantageous, in suppressing an increase in the cost of the circuit board 35 and in widening design tolerances in the circuit board 35, than the conventional control, where the two frequencies are kept in constant proportions.

In the embodiment, the bias controller 33 can vary the charging alternating-current frequency while keeping the developing alternating-current frequency fixed, or can vary the developing alternating-current frequency while keeping the charging alternating-current frequency fixed. In either case, by varying the charging or developing alternating-current frequency in a way that fulfills Conditional Formula (1) noted above, it is possible to obtain the above-mentioned effects of the embodiment.

In a case where the charging alternating-current frequency is varied while the developing alternating-current frequency is kept fixed, the bias controller 33 can vary the charging alternating-current frequency within the range of a predetermined amount of frequency variation relative to a center frequency that includes the above-mentioned variation region. For example, when the developing alternating-current frequency is 2700 Hz (fixed) and the variation region of the charging alternating-current frequency in which interference fringes appear in the image is from 2650 to 2750 Hz, the bias controller 33 can vary the charging alternating-current frequency within the range of from 2500 to 2900 Hz against the fixed developing alternating-current frequency. In this case, the center frequency of the charging alternating-current frequency is 2700 Hz, and the range of the predetermined amount of frequency variation relative to the center frequency is a range of ±200 Hz relative to the center frequency. By varying the charging alternating-current frequency within a range including the above-mentioned variation region, it is possible to reliably suppress the image defects due to interference between the charging and developing alternating-current frequencies in the variation region.

On the other hand, in a case where the developing alternating-current frequency is varied while the charging alternating-current frequency is kept fixed, the bias controller 33 can vary the developing alternating-current frequency within the range of a predetermined amount of frequency variation relative to a center frequency that includes the above-mentioned variation region. For example, when the charging alternating-current frequency is 2700 Hz (fixed) and the variation region of the developing alternating-current frequency in which interference fringes appear in the image is from 2650 to 2750 Hz, the bias controller 33 can vary the developing alternating-current frequency within the range of from 2500 to 2900 Hz against the fixed charging alternating-current frequency. In this case, the center frequency of the developing alternating-current frequency is 2700 Hz, and the range of the predetermined amount of frequency variation relative to the center frequency is a range of ±200 Hz relative to the center frequency. By varying the developing alternating-current frequency within a range including the above-mentioned variation region, it is possible to reliably suppress the image defects due to interference between the charging and developing alternating-current frequencies in the variation region.

Example 1

Figure 4:
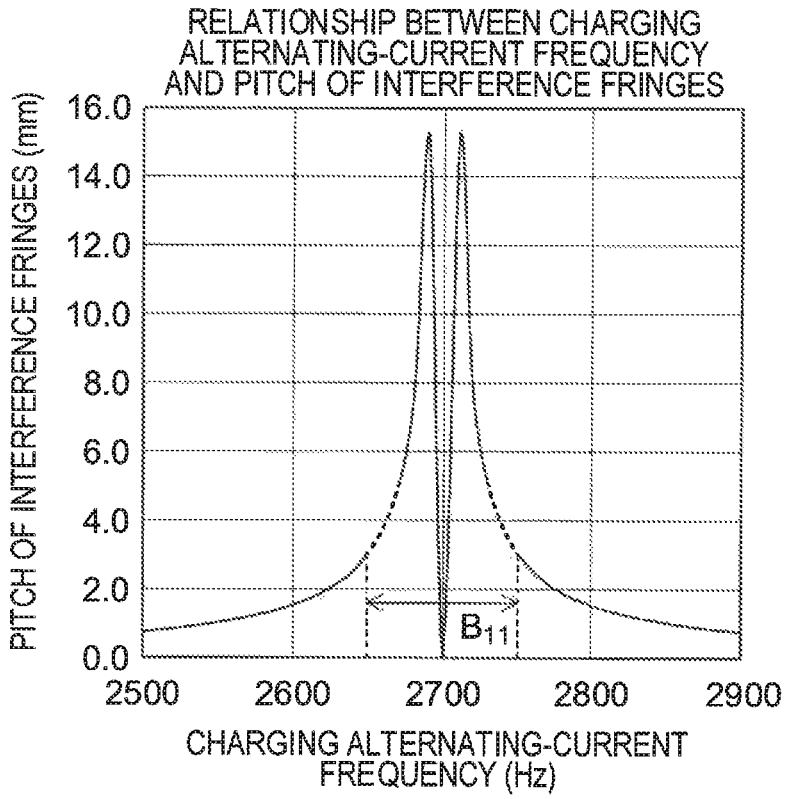
FIG. 4 is a plot showing the relationship, observed when interference fringes are generated by keeping a developing alternating-current frequency fixed and varying a charging alternating-current frequency, between the charging alternating-current frequency and the pitch of the interference fringes in the image forming apparatus.

Next, a practical example of charging bias control in the embodiment will be described. FIG. 4 is a plot showing the relationship between the charging alternating-current frequency and the pitch of interference fringes when the interference fringes (first interference fringes) were generated as the charging alternating-current frequency was varied while the developing alternating-current frequency was kept fixed at 2700 Hz. During the testing, the linear velocity of the photosensitive drum 5 was 152 mm/sec, the distance between the developing roller 8*a* and the photosensitive drum 5 was 0.3 mm, and the linear velocity ratio of the developing roller 8*a* to photosensitive drum 5 was 1.62; the charging direct-current voltage V1dc was 350 V, the charging alternating-current voltage V1ac was 1 kV on a peak-to-peak Vpp basis, the developing direct-current voltage V2dc was 180 V, and the developing alternating-current voltage V2ac was 1500 V on a peak-to-peak Vpp basis.

In general, interference fringes in an image tend to be visually recognizable by humans in ranges of about ±1 to 2% relative to the developing alternating-current frequency (from about 2650 to about 2670 Hz, from about 2730 to about 2750 Hz) (see the broken-line segments of the plot in FIG. 4). In the following description, these ranges are referred to also as the interference regions. The interference fringes do appear also between 2670 and 2700 Hz and between 2700 and 2730 Hz, where, however, their longer pitch makes them less visually recognizable than in the interference regions. In the following description, the range from 2650 to 2750 Hz, where the interference fringes appear in the image, is referred to also as the variation region.

Figure 5:
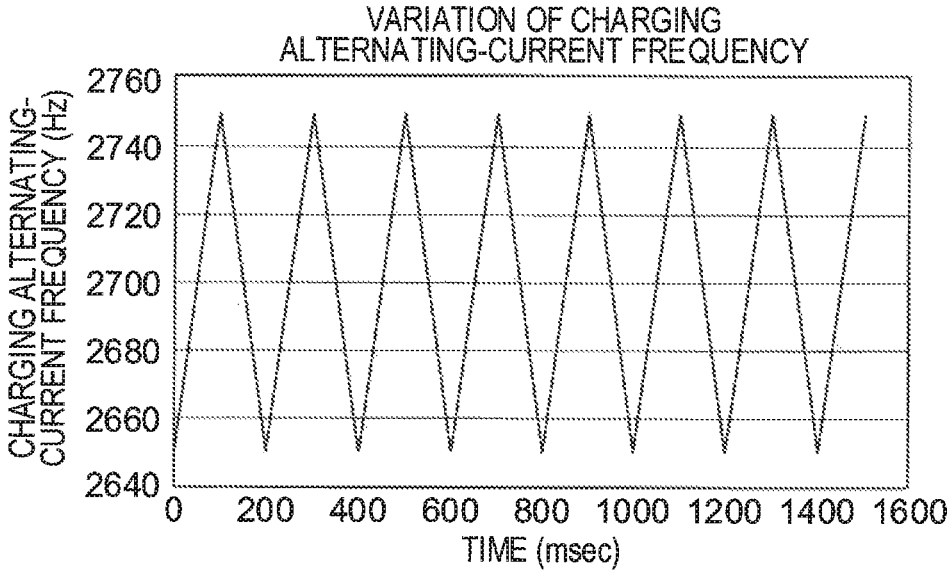
FIG. 5 is a plot showing variation of the charging alternating-current frequency.

Next, the charging alternating-current frequency was varied by spectrum spreading within the range (variation region) of from 2650 to 2750 Hz including the above-mentioned interference region. For example, the charging alternating-current frequency was varied across 100 Hz from 2650 to 2750 Hz for a duration of 100 msec. FIG. 5 is a plot showing the variation of the charging alternating-current frequency between 2650 Hz and 2750 Hz. Then, the variation duration was varied from 100 msec mentioned above so that the variation speed of the charging alternating-current frequency was varied and, after development, the image transferred to the sheet was inspected for the first interference fringes. The results are shown in Table 1.

TABLE 1

| | | | | | | | |
|---|---|---|---|---|---|---|---|
| Variation Duration $t_{11}$ (msec) of Charging Alternating-Current Frequency Across 100 Hz (2650-2750 Hz) | 100 | 50 | 25 | 20 | 15 | 10 | 5 |
| Variation Speed of Charging Alternating-Current Frequency $D_{11} = 100/t_{11}$ (Hz/msec) $= 100000/t_{11}$ (Hz/sec) | 1000 | 2000 | 4000 | 5000 | 6666.667 | 10000 | 20000 |
| Interference | Yes | Yes | Yes | Yes | No | No | No |

$t_{11} = 17.117$ (msec)
$D_{11} = B_{11}/(A_{11}/C_{11})$
$= 5842$ (Hz/sec)

In Table 1, interference was evaluated as follows: when 80 or more in 100 people who saw an image recognized the first interference fringes, interference was evaluated to be present ("Yes"); when 79 or less in 100 people who saw an image recognized the first interference fringes, interference was evaluated to be absent ("No").

When the first interference fringes appear in the developed image due to interference between the charging and developing alternating-current frequencies, the recognizable minimum pitch of the first interference fringes is $A_{11}$ (mm), the width of the variation region of the charging alternating-current frequency is $B_{11}$ (Hz), the rotation speed of the photosensitive drum is $C_{11}$ (mm/sec), and the variation speed of the charging alternating-current frequency in the variation region is $D_{11}$ (Hz/sec).

The minimum pitch $A_{11}$ is the pitch of the interference fringes within ±2% of the developing alternating-current frequency 2700 Hz, and is given by 152 (mm/sec)/|2700×0.02 (Hz)|=2.81 mm. The width $B_{11}$ of the variation region of the charging alternating-current frequency when the first interference fringes appear in the image is given by |2700×0.02|×2=108 (Hz). Since the rotation speed $C_{11}$ of the photosensitive drum is 152 (mm/sec), $B_{11}/(A_{11}/C_{11})$=108/(2.81/152)=5842 (Hz/sec)

From Table 1, it can be clearly understood that the first interference fringes are unrecognizable when the variation duration $t_{11}$ of the charging alternating-current frequency across 100 Hz from 2650 Hz to 2750 Hz is 15 (msec) or less, that is, when the variation speed $D_{11}$ of the charging alternating-current frequency is 6666.667 (Hz/sec) or more. Moreover, based on the fact that the first interference fringes are recognizable when the just-mentioned variation duration $t_{11}$ is 20 (msec), that is, when the variation speed $D_{11}$ is 5000 (Hz/sec), it can be easily inferred that there is a threshold value beyond which the first interference fringes are unrecognizable within the region where the variation duration $t_{11}$ is between 20 (msec) and 15 (msec), that is, within the region where the variation speed $D_{11}$ is between 5000 (Hz/sec) and 6666.667 (Hz/sec). The above-mentioned value 5842 (Hz/sec) is approximately the middle value between 5000 (Hz/sec) and 6666.667 (Hz/sec), and is therefore considered to correspond to the above-mentioned threshold value. Accordingly, with respect to the variation speed $D_{11}$ of the charging alternating-current frequency, fulfilling $D_{11}>B_{11}/(A_{11}/C_{11})$ makes the first interference fringes visually unrecognizable in the developed image, and helps suppress the image defects due to interference between the charging and developing alternating-current frequencies.

If it is assumed that the variation speed at which the charging alternating-current frequency is varied from 2650 Hz to 2750 Hz is positive, the variation speed at which the charging alternating-current frequency is varied from 2750 Hz to 2650 Hz is negative. It was however confirmed that, even when the variation speed was negative, in terms of the relationship between the absolute value of the variation speed and the interference observed, results similar to those shown in Table 1 were obtained. Accordingly, when the sign of the variation speed is taken into consideration, with respect to the variation speed $D_{11}$ of the charging alternating-current frequency, it can be said that fulfilling $|D_{11}|>B_{11}/(A_{11}/C_{11})$ helps suppress the image defects due to interference between the charging and developing alternating-current frequencies.

Example 2

Figure 6:
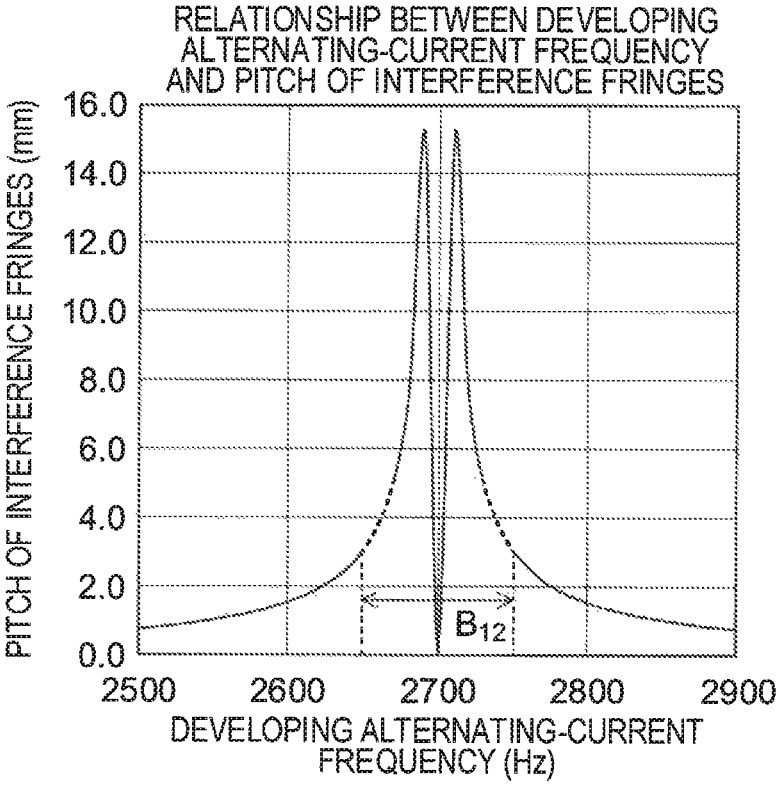
FIG. 6 is a plot showing the relationship, observed when interference fringes are generated by keeping the charging alternating-current frequency fixed and varying the developing alternating-current frequency, between the developing alternating-current frequency and the pitch of the interference fringes in the image forming apparatus.

Next, a practical example of developing bias control will be described. FIG. 6 is a plot showing the relationship between the developing alternating-current frequency and the pitch of interference fringes when interference fringes (first interference fringes) were generated as the developing alternating-current frequency was varied while the charging alternating-current frequency was kept fixed at 2700 Hz. During the testing, the linear velocity of the photosensitive drum 5 was 152 mm/sec, the distance between the developing roller 8*a* and the photosensitive drum 5 was 0.3 mm, and the linear velocity ratio of the developing roller 8*a* to photosensitive drum 5 was 1.62; the charging direct-current voltage V1dc was 350 V, the charging alternating-current voltage V1ac was 1 kV on a peak-to-peak Vpp basis, the developing direct-current voltage V2dc was 180 V, and the developing alternating-current voltage V2ac was 1500 V on a peak-to-peak Vpp basis.

In general, interference fringes in an image tend to be visually recognizable by humans in ranges of about ±1 to 2% relative to the charging alternating-current frequency (from about 2650 to about 2670 Hz, from about 2730 to about 2750

Hz) (see the broken-line segments of the plot in FIG. 6). In the following description, these ranges are referred to also as the interference region. Interference fringes do appear also between 2670 and 2700 Hz and between 2700 and 2730 Hz, where, however, their longer pitch makes them less visually recognizable than in the interference region. In the following description, the range from 2650 to 2750 Hz, where the interference fringes appear in the image, is referred to also as the variation region.

Figure 7:
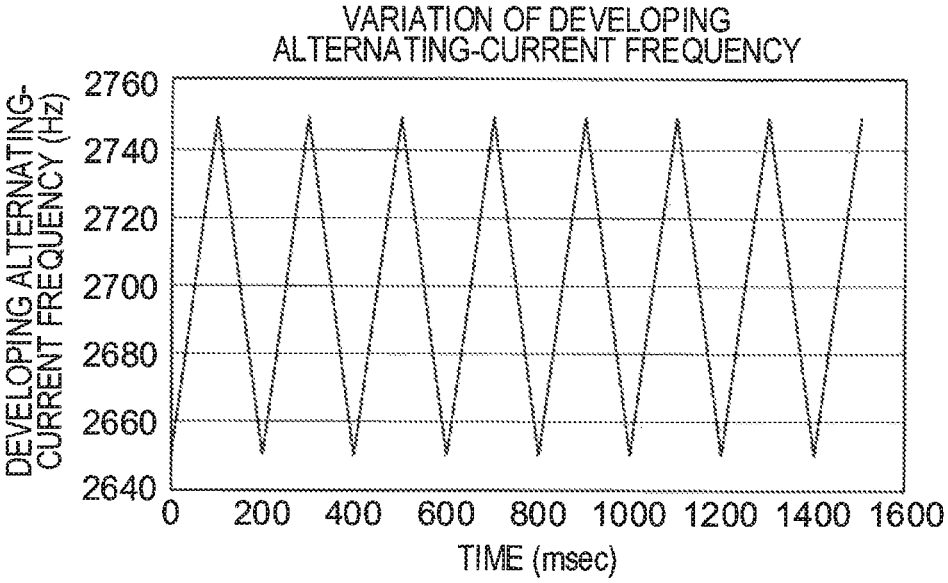
FIG. 7 is a plot showing variation of the developing alternating-current frequency.

Next, the developing alternating-current frequency was varied by spectrum spreading within the range (variation region) of from 2650 to 2750 Hz including the above-mentioned interference region. For example, the developing alternating-current frequency was varied across 100 Hz from 2650 to 2750 Hz for a duration of 100 msec. FIG. 7 is a plot showing the variation of the developing alternating-current frequency between 2650 Hz and 2750 Hz. Then, the variation duration was varied from 100 msec mentioned above so that the variation speed of the developing alternating-current frequency was varied and, after development, the image transferred to the sheet was inspected for the first interference fringes. The results are shown in Table 2. In table 2, interference was evaluated in a similar manner as in Example 1.

TABLE 2

| | | | | | | | |
|---|---|---|---|---|---|---|---|
| Variation Duration $t_{12}$ (msec) of Developing Alternating-Current Frequency Across 100 Hz (2650-2750 Hz) | 100 | 50 | 25 | 20 | 15 | 10 | 5 |
| Variation Speed of Developing Alternating-Current Frequency $D_{12} = 100/t_{12}$ (Hz/msec) $= 100000/t_{12}$ (Hz/sec) | 1000 | 2000 | 4000 | 5000 | 6666.667 | 10000 | 20000 |
| Interference | Yes | Yes | Yes | Yes | No | No | No |

$t_{12} = 17.117$ (msec)
$D_{12} = B_{12}/(A_{12}/C_{12})$
$= 5842$ (Hz/sec)

When the interference fringes appear in the developed image due to interference between the charging and developing alternating-current frequencies, the recognizable minimum pitch of the first interference fringes is $A_{12}$ (mm), the width of the variation region of the developing alternating-current frequency is $B_{12}$ (Hz), the rotation speed of the photosensitive drum is $C_{12}$ (mm/sec), and the variation speed of the developing alternating-current frequency in the variation region is $D_{12}$ (Hz/sec).

The minimum pitch $A_{12}$ is the pitch of interference fringes within ±2% of the charging alternating-current frequency 2700 Hz, and is given by 152 (mm/sec)/|2700×0.02 (Hz)|=2.81 mm. The width $B_{12}$ of the variation region of the developing alternating-current frequency when the first interference fringes appear in the image is given by |2700×0.02|×2=108 (Hz). Since the rotation speed $C_{12}$ of the photosensitive drum is 152 (mm/sec), $B_{12}/(A_{12}/C_{12})$=108/(2.81/152)=5842 (Hz/sec).

From Table 2, it can be dearly understood that the first interference fringes are unrecognizable when the variation duration $t_{12}$ of the developing alternating-current frequency across 100 Hz from 2650 to 2750 Hz is 15 (msec) or less, that is, when the variation speed $D_{12}$ of the developing alternating-current frequency is 6666.667 (Hz/sec) or more. Moreover, based on the fact that the first interference fringes are recognizable when the just-mentioned variation duration $t_{12}$ is 20 (msec), that is, when the variation speed $D_{12}$ is 5000 (Hz/sec), it can be easily inferred that there is a threshold value beyond which the first interference fringes are unrecognizable within the region where the variation duration $t_{12}$ is between 20 (msec) and 15 (msec), that is, within the region where the variation speed $D_{12}$ is between 5000 (Hz/sec) and 6666.667 (Hz/sec). The above-mentioned value 5842 (Hz/sec) is approximately the middle value between 5000 (Hz/sec) and 6666.667 (Hz/sec), and is therefore considered to correspond to the above-mentioned threshold value. Accordingly, with respect to the variation speed $D_{12}$ of the developing alternating-current frequency, fulfilling $D_{12}>B_{12}/(A_{12}/C_{12})$ makes the first interference fringes visually unrecognizable in the developed image, and helps suppress the image defects due to interference between the charging and developing alternating-current frequencies.

If it is assumed that the variation speed at which the developing alternating-current frequency is varied from 2650 Hz to 2750 Hz is positive, the variation speed at which the developing alternating-current frequency is varied from 2750 Hz to 2650 Hz is negative. It was however confirmed that, even when the variation speed was negative, in terms of the relationship between the absolute value of the variation speed and the interference observed, results similar to those shown in Table 2 were obtained. Accordingly, when the sign of the variation speed is taken into consideration, with respect to the variation speed $D_{12}$ of the developing alternating-current frequency, it can be said that fulfilling $|D_{12}|>B_{12}/(A_{12}/C_{12})$ helps suppress the image defects due to interference between the charging and developing alternating-current frequencies.

[Relationship Between the Charging Alternating-Current Frequency and the Latent Image Frequency]

If there is a deviation between the charging alternating-current frequency and the latent image frequency, which defines the resolution of the electrostatic latent image formed on the photosensitive drum 5, the charging alternating-current frequency and the latent image frequency may interfere with each other to produce interference fringes in the developed image.

To avoid that, it is preferable that the bias controller 33, when varying the charging alternating-current frequency while keeping the developing alternating-current frequency fixed, perform control in a way that further fulfills Conditional Formula (2) below. Specifically, while interference fringes which appear in the developed image due to the above-discussed interference between the charging and developing alternating-current frequencies is first interference fringes, interference between the charging alternating-current frequency and the latent image frequency may produce second interference fringes in the developed image. When the recognizable minimum pitch of such second interference fringes is represented by $A_2$ (mm), the width of the variation region of the charging alternating-current frequency when the second interference fringes appear in the image is $B_2$ (Hz), the rotation speed of the photosensitive drum 5 is $C_2$ (mm/sec), and the variation speed of the charging alternating-current frequency in the variation region is $D_2$ (Hz/sec), then it is preferable that the bias controller 33 vary the charging alternating-current frequency at a variation speed $D_2$ that fulfills $$|D_2|>B_2/(A_2/C_2). \quad (2)$$

Conditional Formula (2) defines an adequate range of the variation speed $D_2$, with consideration given to the rotation speed $C_2$ of the photosensitive drum 5, for reducing interference between the charging alternating-current frequency and the latent image frequency. That is, fulfilling Conditional Formula (2) helps vary the charging alternating-current frequency at an adequate variation speed $D_2$ in accordance with the rotation speed $C_2$ of the photosensitive drum 5, and thereby helps reduce interference between the charging alternating-current frequency and the latent image frequency in the variation region. It is thus possible not only to suppress the image defects due to the above-discussed interference between the charging and developing alternating-current frequencies but also to suppress the image defects due to interference between the charging alternating-current frequency and the latent image frequency.

In a case where the variation region of the charging alternating-current frequency when the first interference fringes appear in an image and the variation region of the charging alternating-current frequency when the second interference fringes appear in the image overlap, in the region (frequency variation range) where they overlap, the charging alternating-current frequency can be varied at a variation speed that fulfills Conditional Formulae (1) and (2) simultaneously, that is, at the higher of $D_1$ and $D_2$.

Example 3

Figure 8:
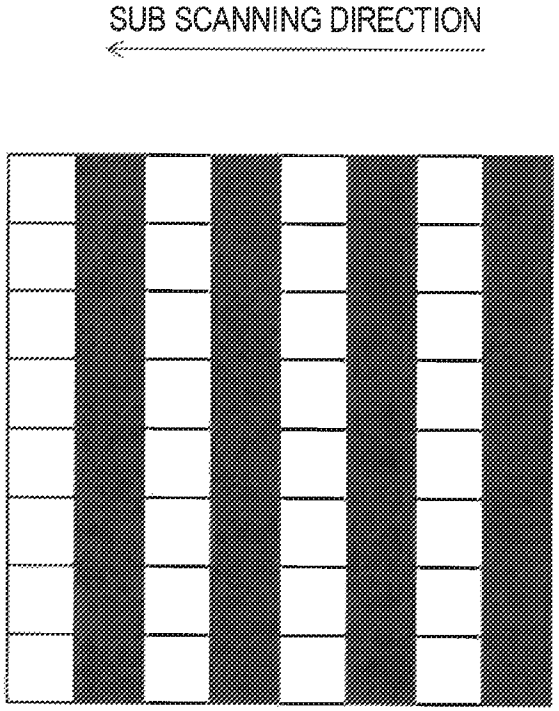
FIG. 8 is a diagram illustrating one example of an image formed along a sub scanning direction.

Next, a practical example of variable control of the charging alternating-current frequency with consideration given to the latent image frequency will be described. Here, consider a case where, as shown in FIG. 8, a one-on one-off 50% image (electrostatic latent image) is formed along the sub scanning direction (corresponding to the peripheral direction of the photosensitive drum) at a resolution of 600 dpi.

The dot interval along the sub scanning direction is, since one inch equals 2.54 cm, 2.54/600=0.004233 cm. In an image with a two-dot interval along the sub scanning direction as shown in FIG. 8, the dot interval is 0.004233×2=0.008466 cm=0.08466 mm. When the linear velocity of the photosensitive drum 5 is 152 mm/sec, the line interval along the sub scanning direction is 0.08466/152=0.0005565 sec. Thus, the latent image frequency is given by $$\text{Latent Image Frequency (Hz)}=1/\text{Line Interval (sec)}$$
$$1/0.0005565\approx 1795.$$

Figure 9:
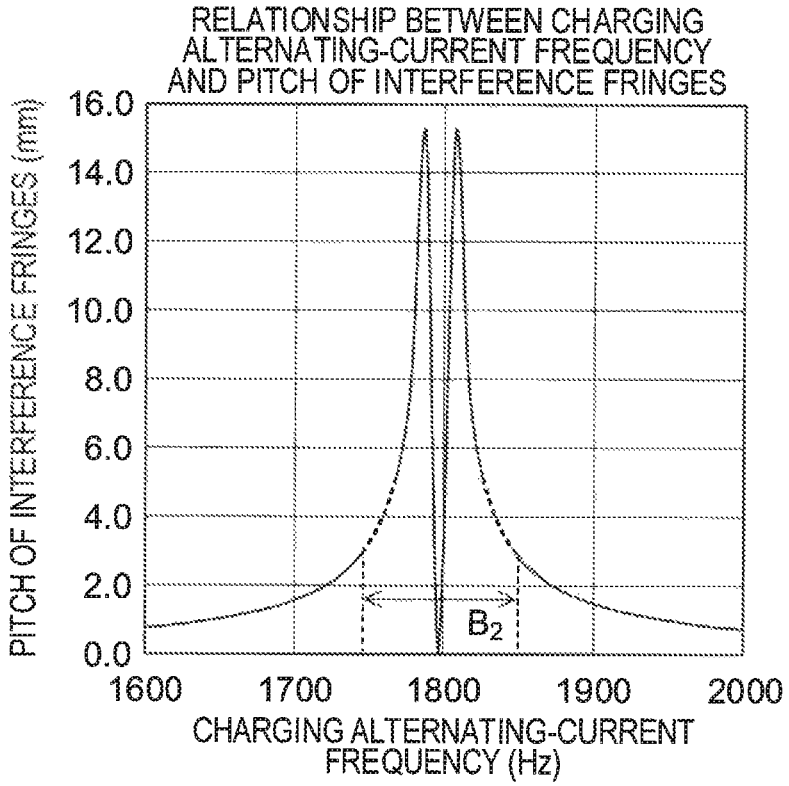
FIG. 9 is a plot showing the relationship, observed when interference fringes due to interference between the charging alternating-current frequency and a latent image frequency are generated by varying the charging alternating-current frequency with respect to the latent image frequency, between the charging alternating-current frequency and the pitch of the interference fringes in the image forming apparatus.

FIG. 9 is a plot showing the relationship between the charging alternating-current frequency and the pitch of interference fringes when the interference fringes (second interference fringes) due to interference between the charging alternating-current frequency and the latent image frequency are generated by varying the charging alternating-current frequency against the latent image frequency. During the testing, the linear velocity of the photosensitive drum 5 was 152 mm/sec, the distance between the developing roller 8*a* and the photosensitive drum 5 was 0.3 mm, and the linear velocity ratio of the developing roller 8*a* to photosensitive drum 5 was 1.62; the charging direct-current voltage V1dc was 350 V, the charging alternating-current voltage V1ac was 1 kV on a peak-to-peak Vpp basis, the developing direct-current voltage V2dc was 180 V, and the developing alternating-current voltage V2ac was 1500 V on a peak-to-peak Vpp basis.

In general, the second interference fringes in an image tend to be visually recognizable by humans in ranges of about ±1 to 2% relative to the latent image frequency (from about 1750 to about 1780 Hz, from about 1820 to about 1850 Hz) (see the broken-line segments of the plot in FIG. 9). In the following description, these ranges are referred to also as the interference region. The second interference fringes do appear also between 1780 and 1795 Hz and between 1795 and 1820 Hz, where, however, their longer pitch makes them less visually recognizable than in the interference region. In the following description, the range from 1750 to 1850 Hz, where the second interference fringes appear in the image, is referred to also as the variation region.

Next, the charging alternating-current frequency was varied by spectrum spreading within the range (variation region) of from 1750 to 1850 Hz including the above-mentioned interference region. For example, the charging alternating-current frequency was varied across 100 Hz from 1750 to 1850 Hz for a duration of 100 msec. Then, the variation duration was varied from 100 msec mentioned above so that the variation speed of the charging alternating-current frequency was varied and, after development, the image transferred to the sheet was inspected for the second interference fringes. The results are shown in Table 3. In table 3, interference was evaluated in a similar manner as in Example 1.

TABLE 3

| | | | | | | | |
|---|---|---|---|---|---|---|---|
| Variation Duration $t_2$ (msec) of Charging Alternating-Current Frequency Across 100 Hz (1750-1850 Hz) | 100 | 50 | 25 | 20 | 15 | 10 | 5 |
| Variation Speed of Charging Alternating-Current Frequency $D_2 = 100/t_2$ (Hz/msec) $= 100000/t_2$ (Hz/sec) | 1000 | 2000 | 4000 | 5000 | 6666.667 | 10000 | 20000 |

TABLE 3-continued

| | | | | | | | |
|---|---|---|---|---|---|---|---|
| Interference | Yes | Yes | Yes | Yes | No | No | No |

$t_2$ = 19.736 (msec)
$D_2 = B_2/(A_2/C_2)$
= 5067 (Hz/sec)

FIG. 9 shows the following. When the second interference fringes appear in the developed image due to interference between the charging alternating-current frequency and the latent image frequency, the recognizable minimum pitch $A_2$ of the second interference fringes is 3 mm, and the width $B_2$ of the variation region of the charging alternating-current frequency is 100 Hz, from 1750 to 1850 Hz. Since the rotation speed $C_2$ of the photosensitive drum is 152 mm/sec, $B_2$ $(A_2/C_2)$=100/(3/152)=5067 (Hz/sec).

From Table 3, it can be clearly understood that the second interference fringes are unrecognizable when the variation duration $t_2$ of the charging alternating-current frequency across 100 Hz from 1750 to 1850 Hz is 15 (msec) or less, that is, when the variation speed $D_2$ of the charging alternating-current frequency in the variation region is 6666.667 (Hz/sec) or more. Moreover, based on the fact that, when the variation duration $t_2$ is 20 (msec), that is, when the variation speed $D_2$ is 5000 (Hz/sec), the second interference fringes are recognizable, it can be easily inferred that there is a threshold value beyond which the second interference fringes are unrecognizable within the region where the variation duration $t_2$ is between 20 (msec) and 15 (msec), that is, within the region where the variation speed $D_2$ is between 5000 (Hz/sec) and 6666.667 (Hz/sec). The above-mentioned value 5067 (Hz/sec) is a value between 5000 (Hz/sec) and 6666.667 (Hz/sec), and is therefore considered to correspond to the above-mentioned threshold value. Accordingly, with respect to the variation speed $D_2$ of the charging alternating-current frequency, fulfilling $D_2>B_2/(A_2/C_2)$ makes the second interference fringes visually unrecognizable in the developed image, and helps suppress the image defects due to interference between the charging alternating-current frequency and the latent image frequency.

If it is assumed that the variation speed at which the charging alternating-current frequency is varied from 1750 to 1850 Hz is positive, the variation speed at which the charging alternating-current frequency is varied from 1850 to 1750 Hz is negative. It was however confirmed that, even when the variation speed was negative, in terms of the relationship between the absolute value of the variation speed and the interference observed, results similar to those shown in Table 3 were obtained. Accordingly, when the sign of the variation speed is taken into consideration, with respect to the variation speed $D_2$ of the charging alternating-current frequency, it can be said that fulfilling $|D_2|>B_2/(A_2/C_2)$ helps suppress the image defects due to interference between the charging alternating-current frequency and the latent image frequency.

[Relationship Between the Developing Alternating-Current Frequency and the Latent Image Frequency]

Likewise, if there is a deviation between the developing alternating-current frequency and the latent image frequency, the developing alternating-current frequency and the latent image frequency may interfere with each other to produce interference fringes in the developed image.

To avoid that, it is preferable that the bias controller 33, when varying the developing alternating-current frequency while keeping the charging alternating-current frequency fixed, perform control in a way that further fulfills Conditional Formula (3) below. Specifically, while interference fringes which appear in the developed image due to the above-discussed interference between the charging and developing alternating-current frequencies is first interference fringes, interference between the developing alternating-current frequency and the latent image frequency may produce third interference fringes in the developed image. When the recognizable minimum pitch of such third interference fringes is represented by $A_3$ (mm), the width of the variation region of the developing alternating-current frequency when the third interference fringes appear in the image is $B_3$ (Hz), the rotation speed of the photosensitive drum 5 is $C_3$ (mm/sec), and the variation speed of the developing alternating-current frequency in the variation region is $D_3$ (Hz/sec), then it is preferable that the bias controller 33 vary the developing alternating-current frequency at a variation speed $D_3$ that fulfills $$|D_3|>B_3/(A_3/C_3). \tag{3}$$

Conditional Formula (3) defines an adequate range of the variation speed $D_3$, with consideration given to the rotation speed $C_3$ of the photosensitive drum 5, for reducing interference between the developing alternating-current frequency and the latent image frequency. That is, fulfilling Conditional Formula (3) helps vary the developing alternating-current frequency at an adequate variation speed $D_3$ in accordance with the rotation speed $C_3$ of the photosensitive drum 5, and thereby helps reduce interference between the developing alternating-current frequency and the latent image frequency in the variation region. It is thus possible not only to suppress the image defects due to the above-discussed interference between the charging and developing alternating-current frequencies but also to suppress the image defects due to interference between the developing alternating-current frequency and the latent image frequency.

In a case where the variation region of the developing alternating-current frequency when the first interference fringes appear in an image and the variation region of the developing alternating-current frequency when the third interference fringes appear in the image overlap, in the region (frequency variation range) where they overlap, the developing alternating-current frequency can be varied at a variation speed that fulfills Conditional Formulae (1) and (3) simultaneously, that is, at the higher of $D_1$ and $D_3$.

Example 4

Next, a practical example of variable control of the developing alternating-current frequency with consideration given to the latent image frequency will be described. Here, as in Example 3, consider a case where, as shown in FIG. 8, a one-on one-off 50% image (electrostatic latent image) is formed along the sub scanning direction (corresponding to the peripheral direction of the photosensitive drum) at a resolution of 600 dpi. It is here also assumed that the electrostatic latent image is formed with the latent image frequency at 1795 Hz under the same conditions as in Example 3.

Figure 10:
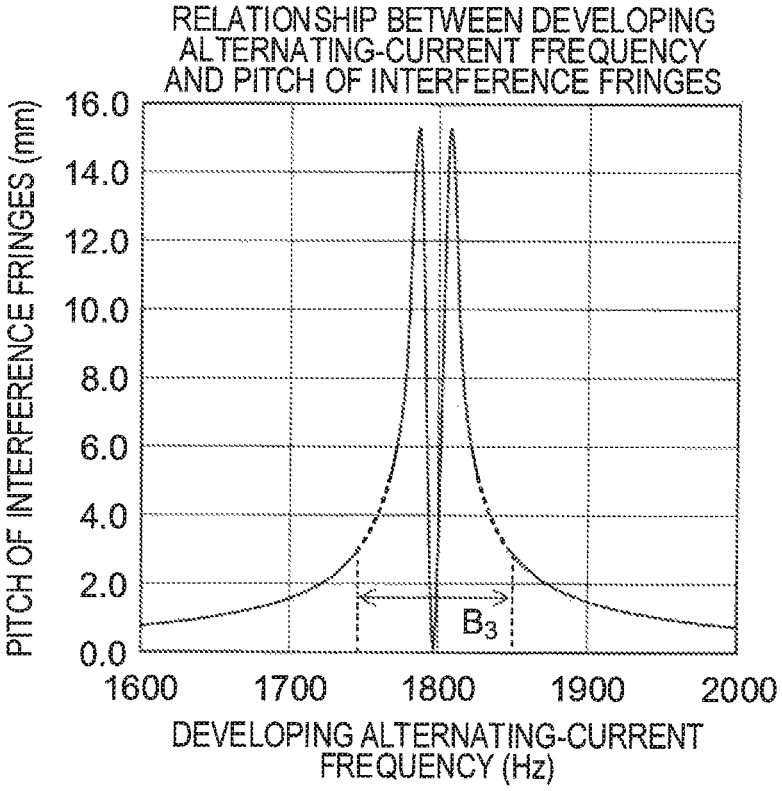
FIG. 10 is a plot showing the relationship, observed when interference fringes due to interference between the developing alternating-current frequency and the latent image frequency are generated by varying the developing alternating-current frequency with respect to the latent image frequency, between the developing alternating-current frequency and the pitch of the interference fringes in the image forming apparatus.

FIG. 10 is a plot showing the relationship between the developing alternating-current frequency and the pitch of the interference fringes when the interference fringes (third interference fringes) due to interference between the developing alternating-current frequency and the latent image frequency are generated by varying the developing alternating-current frequency against the latent image frequency. During the testing, the linear velocity of the photosensitive drum 5 was 152 mm/sec, the distance between the developing roller 8*a* and the photosensitive drum 5 was 0.3 mm, and the linear velocity ratio of the developing roller 8*a* to photosensitive drum 5 was 1.62; the charging direct-current voltage V1dc was 350 V, the charging alternating-current voltage V1ac was 1 kV on a peak-to-peak Vpp basis, the developing direct-current voltage V2dc was 180 V, and the developing alternating-current voltage V2ac was 1500 V on a peak-to-peak Vpp basis.

In general, the third interference fringes in an image tend to be visually recognizable by humans in ranges of about ±1 to 2% relative to the latent image frequency (from about 1750 to about 1780 Hz, from about 1820 to about 1850 Hz) (see the broken-line segments of the plot in FIG. 10). In the following description, these ranges are referred to also as the interference region. The third interference fringes do appear also between 1780 and 1795 Hz and between 1795 and 1820 Hz, where, however, their longer pitch makes them less visually recognizable than in the interference region. In the following description, the range from 1750 to 1850 Hz, where the third interference fringes appear in the image, is referred to also as the variation region.

Next, the developing alternating-current frequency was varied by spectrum spreading within the range (variation region) of from 1750 to 1850 Hz including the above-mentioned interference region. For example, the developing alternating-current frequency was varied across 100 Hz from 1750 to 1850 Hz for a duration of 100 msec. Then, the variation duration was varied from 100 msec mentioned above so that the variation speed of the developing alternating-current frequency was varied and, after development, the image transferred to the sheet was inspected for the third interference fringes. The results are shown in Table 4. In table 4, interference was evaluated in a similar manner as in Example 1.

TABLE 4

| | | | | | | | |
|---|---|---|---|---|---|---|---|
| Variation Duration $t_3$ (msec) of Developing Alternating-Current Frequency Across 100 Hz (1750-1850 Hz) | 100 | 50 | 25 | 20 | 15 | 10 | 5 |
| Variation Speed of Developing Alternating-Current Frequency $D_3 = 100/t_3$ (Hz/msec) $= 100000/t_3$ (Hz/sec) | 1000 | 2000 | 4000 | 5000 | 6666.667 | 10000 | 20000 |
| Interference | Yes | Yes | Yes | Yes | No | No | No |

$t_3 = 19.736$ (msec)
$D_3 = B_3/(A_3/C_3)$
$= 5067$ (Hz/sec)

FIG. 10 shows the following. When the third interference fringes appear in the developed image due to interference between the developing alternating-current frequency and the latent image frequency, the recognizable minimum pitch $A_3$ of the third interference fringes is 3 mm, and the width $B_3$ of the variation region of the developing alternating-current frequency is 100 Hz, from 1750 to 1850 Hz. Since the rotation speed $C_3$ of the photosensitive drum is 152 mm/sec, $B_3/(A_3/C_3)=100/(3/152)=5067$ (Hz/sec).

From Table 4, it can be clearly understood that the third interference fringes are unrecognizable when the variation duration $t_3$ of the developing alternating-current frequency across 100 Hz from 1750 to 1850 Hz is 15 (msec) or less, that is, when the variation speed $D_3$ of the developing alternating-current frequency in the variation region is 6666.667 (Hz/sec) or more. Moreover, based on the fact that, when the variation duration $t_3$ is 20 (msec), that is, when the variation speed $D_3$ is 5000 (Hz/sec), the third interference fringes are recognizable, it can be easily inferred that there is a threshold value beyond which the third interference fringes are unrecognizable within the region where the variation duration $t_3$ is between 20 (msec) and 15 (msec), that is, within the region where the variation speed $D_3$ is between 5000 (Hz/sec) and 6666.667 (Hz/sec). The above-mentioned value 5067 (Hz/sec) is a value between 5000 (Hz/sec) and 6666.667 (Hz/sec), and is therefore considered to correspond to the above-mentioned threshold value. Accordingly, with respect to the variation speed $D_3$ of the developing alternating-current frequency, fulfilling $D_3>B_3/(A_3/C_3)$ makes the third interference fringes visually unrecognizable in the developed image, and helps suppress the image defects due to interference between the developing alternating-current frequency and the latent image frequency.

If it is assumed that the variation speed at which the developing alternating-current frequency is varied from 1750 to 1850 Hz is positive, the variation speed at which the developing alternating-current frequency is varied from 1850 to 1750 Hz is negative. It was however confirmed that, even when the variation speed was negative, in terms of the relationship between the absolute value of the variation speed and the interference observed, results similar to those shown in Table 4 were obtained. Accordingly, when the sign of the variation speed is taken into consideration, with respect to the variation speed $D_3$ of the developing alternating-current frequency, it can be said that fulfilling $|D_3|>B_3/(A_3/C_3)$ helps suppress the image defects due to interference between the developing alternating-current frequency and the latent image frequency.

[Modifications]

The above embodiment deals with control in which a charging alternating-current frequency or a developing alternating-current frequency is varied as applied to a structure where a charging roller 4*a* is in contact with a photosensitive drum 5. Instead, control similar to that of the embodiment can be applied to a structure where a charging roller 4*a* and a photosensitive drum 5 are arranged with no contact between them (close together). Also then, effects similar to those of the embodiment can be obtained.

Although the above embodiment deals with an example where an amorphous silicon photoconductor is used as the photosensitive drum 5, also in a case where, for example, an organic photoconductor (OPC) is used, control similar to that in the embodiment brings effects similar to those of the embodiment.

Although the above embodiment deals with control in which a charging alternating-current frequency or a developing alternating-current frequency is varied as applied to a monochrome printer, control according to the embodiment can be applied to various image forming apparatuses such as monochrome copiers, color copiers, color printers, facsimile machines, multifunction peripherals, etc. Also then, effects similar to those of the embodiment can be obtained.

The present disclosure find applications in image forming apparatuses such as monochrome printers.

The description of an embodiment of the present disclosure given above is not meant to limit the scope of the present disclosure; what is disclosed herein can be implemented with any modifications made within the spirit of the present disclosure.

What is claimed is:

1. An image forming apparatus comprising:

a charging device that applies to a charging member a charging bias having a charging alternating-current voltage superposed on a charging direct-current voltage and that brings the charging member close to or into contact with an image carrying member to electrostatically charge a surface of the image carrying member;

an electrostatic latent image forming device that forms an electrostatic latent image on the surface of the image carrying member electrostatically charged by the charging device;

a developing device that develops the electrostatic latent image on the surface of the image carrying member with a developing bias having a developing alternating-current voltage superposed on a developing direct-current voltage; and a bias controller that varies one, while keeping another fixed, of a charging alternating-current frequency, which is a frequency of the charging alternating-current voltage, and a developing alternating-current frequency, which is a frequency of the developing alternating-current voltage, wherein in a case where interference fringes appear in a developed image due to interference between the charging and developing alternating-current frequencies, when a recognizable minimum pitch of the interference fringes is $A_1$ (mm), a width of a variation region of the another of the charging and developing alternating-current frequencies when the interference fringes appear in the image is $B_1$ (Hz), a rotation speed of the image carrying member is $C_1$ (mm/sec), and a variation speed of the another of the charging and developing alternating-current frequencies in the variation region is $D_1$ (Hz/sec), then the bias controller varies the another of the charging and developing alternating-current frequencies at the variation speed $D_1$ that fulfills $$|D_1|>B_1/(A_1/C_1).$$

2. The image forming apparatus according to claim 1, wherein the bias controller keeps the developing alternating-current frequency fixed and varies the charging alternating-current frequency.

3. The image forming apparatus according to claim 2, wherein the bias controller varies the charging alternating-current frequency within a range of a predetermined amount of frequency variation relative to a center frequency, the range including the variation region.

4. The image forming apparatus according to claim 2, wherein the interference fringes that appear in the developed image due to interference between the charging and developing alternating-current frequencies are first interference fringes, in a case where second interference fringes appear in the developed image due to interference between the charging alternating-current frequency and a latent image frequency, which defines a resolution of the electrostatic latent image, when a recognizable minimum pitch of second interference fringes is $A_2$ (mm), a width of a variation region of the charging alternating-current frequency when the second interference fringes appear in the image is $B_2$ (Hz), a rotation speed of the image carrying member is $C_2$ (mm/sec), and a variation speed of the charging alternating-current frequency in the variation region is $D_2$ (Hz/sec), then the bias controller varies the charging alternating-current frequency at the variation speed $D_2$ that fulfills $$|D_2|>B_2/(A_2/C_2).$$

5. The image forming apparatus according to claim 1, wherein the bias controller keeps the charging alternating-current frequency fixed and varies the developing alternating-current frequency.

6. The image forming apparatus according to claim 5, wherein the bias controller varies the developing alternating-current frequency within a range of a predetermined amount of frequency variation relative to a center frequency, the range including the variation region.

7. The image forming apparatus according to claim 5, wherein the interference fringes that appear in the developed image due to interference between the charging and developing alternating-current frequencies are first interference fringes, in a case where third interference fringes appear in the developed image due to interference between the developing alternating-current frequency and a latent image frequency, which defines a resolution of the electrostatic latent image, when a recognizable minimum pitch of the third interference fringes is $A_3$ (mm), a width of a variation region of the developing alternating-current frequency when the third interference fringes appear in the image is $B_3$ (Hz), a rotation speed of the image carrying member is $C_3$ (mm/sec), and a variation speed of the developing alternating-current frequency in the variation region is $D_3$ (Hz/sec), then the bias controller varies the developing alternating-current frequency at the variation speed $D_3$ that fulfills $$|D_3|>B_3/(A_3/C_3).$$

* * * * *